US008342095B2

(12) United States Patent
Bassett

(10) Patent No.: US 8,342,095 B2
(45) Date of Patent: Jan. 1, 2013

(54) SELF-STEMMING CARTRIDGE

(76) Inventor: Carroll Bassett, Friars Hill, WV (US)

( * ) Notice: Subject to any disclaimer, the term of this patent is extended or adjusted under 35 U.S.C. 154(b) by 508 days.

(21) Appl. No.: 12/445,859

(22) PCT Filed: Oct. 17, 2007

(86) PCT No.: PCT/US2007/081705

§ 371 (c)(1),
(2), (4) Date: Apr. 16, 2009

(87) PCT Pub. No.: WO2008/100347

PCT Pub. Date: Aug. 21, 2008

(65) Prior Publication Data

US 2010/0276984 A1 Nov. 4, 2010

Related U.S. Application Data

(60) Provisional application No. 60/862,124, filed on Oct. 19, 2006.

(51) Int. Cl.
*F42D 1/22* (2006.01)
*F42B 3/04* (2006.01)

(52) U.S. Cl. ..... 102/333; 102/314; 102/322; 102/313; 102/304; 299/13; 86/1.1

(58) Field of Classification Search ..... 102/304, 102/313, 314, 322, 333; 299/13; 86/1.1
See application file for complete search history.

(56) References Cited

U.S. PATENT DOCUMENTS

| | | | | |
|---|---|---|---|---|
| 137,196 | A | 3/1873 | Gotham | |
| 806,495 | A | 12/1905 | Rasmussen | |
| 1,616,048 | A | 6/1925 | Holt | |
| 1,832,132 | A | 1/1928 | Lanier et al. | |
| 2,007,568 | A | 12/1934 | Heitzman | |
| 2,112,906 | A | 6/1935 | Dietz | |
| 2,296,504 | A | 7/1938 | Crater | |
| 2,685,836 | A | 8/1954 | Sauvage | |
| 3,952,656 | A | 4/1976 | Fox et al. | |
| 4,214,532 | A * | 7/1980 | Oulsnam | 102/333 |
| 4,546,703 | A | 10/1985 | Thompson | |
| 4,754,705 | A | 7/1988 | Worsey | |
| 5,247,886 | A | 9/1993 | Worsey | |
| 5,765,923 | A * | 6/1998 | Watson et al. | 299/13 |
| 6,035,784 | A * | 3/2000 | Watson | 102/313 |
| 6,339,992 | B1 | 1/2002 | Watson | |
| 6,386,111 | B1 | 5/2002 | Shann | |
| 2008/0047455 | A1 * | 2/2008 | Tota | 102/304 |

FOREIGN PATENT DOCUMENTS

| | | |
|---|---|---|
| DE | 305020 | 9/1920 |
| DE | 651287 | 10/1937 |
| FR | 1011964 | 7/1952 |
| WO | WO 00/60301 | * 10/2000 |
| WO | WO2005033474 A1 | 4/2005 |

* cited by examiner

*Primary Examiner* — James Bergin
(74) *Attorney, Agent, or Firm* — Johnston Holroyd; Mary-Jacq Holroyd

(57) ABSTRACT

A cylindrical casing (18) has first and second ends (33 and 31), the first end (33) being closed. The casing (18) encloses an accelerant (22) disposed adjacent the first end (33), at least one stemming mechanism (21), and a fuse (14 or 14') extending from the accelerant (22) out of the second end (31) of the cylindrical casing (18). The cartridge (12) is made of a rupturable cylindrical casing (18) with accelerant (22) and self-stemming mechanism (22) inserted therein. A method of breaking hard (R) materials involves detonating a self-stemming cartridge (12) disposed in a borehole (B).

28 Claims, 4 Drawing Sheets

SELF-STEMMING CARTRIDGE

RELATED APPLICATIONS

This application claims the benefit of U.S. Provisional Application Ser. No. 60/862,124 entitled "SELF-STEMMING CARTRIDGE" filed on 19 Oct. 2006, the contents of which are incorporated herein by reference in its entirety.

BACKGROUND OF THE INVENTION

Historically when blasting techniques are used to crack rock and concrete, an explosive charge is placed in a drilled hole followed by a stemming operation to help retain the force of detonation within the borehole. The stemming operation tends to involve packing the borehole above the explosive charge with some material, such as gravel, clay, and mud, to prevent the explosive force from simply being vented out of the borehole without cracking the rock. This operation is both time consuming and, in some instances, dangerous. Several stemming devices have been developed to eliminate this process; however, they have not seen widespread adoption given their cost, lack of effectiveness in stemming the blast hole or because they are bulky and difficult to use. Most of these known devices are placed in the borehole after the explosive charge.

Self-stemming devices which operate by blocking the borehole upon the action of the force released by the blast are also known. Such devices incorporate the blasting aspect, or charge, within or directly connected to the stemming aspect of the device. U.S. Pat. No. 137,196 issued to Gotham on Mar. 25, 1873 shows self-tamping torpedoes. The self-tamping torpedoes of Gotham were an improvement for blasting consisting of a plug, to which the cartridge is attached, having a diamond-shaped cone upon its top which fits between two sliding weights so that when the torpedo is exploded the plug spreads out thereby causing the blast to be exerted upon the adjacent walls of the hole. The device of Gotham, however, is a large device that is lowered on a cable into a pre-drilled borehole for large scale blasting. Furthermore, the device of Gotham does not have a single casing surrounding both the charge and the stemming aspect, and the casing it does have is a metal casing requiring a significant blast force to function.

Stemming devices and plugs that fit on the blasting cartridge, or have an opening to accommodate the blasting cartridge, are also known. U.S. Pat. No. 2,112,906 issued to Dietz on Jun. 5, 1935 shows a blasting plug which self expands upon detonation of an explosive thereby stemming the borehole, in which the explosive may be inserted into the base of the plug. Similarly, the blasting device of U.S. Pat. No. 1,616,048 issued to Holt on Jun. 30, 1925 operates by stemming a borehole as a result of the detonation of a charge located within the same structure as the self-stemming device. The blasting device of Holt, however, does not incorporate the charge and the stemming apparatus within a common casing, but incorporates the blasting device in a side opening of the stemming device. Likewise, U.S. Pat. No. 806,495 issued to Rasmussen on Dec. 5, 1905 discloses a means for plugging shot holes that operates by stemming the shot hole (borehole) as a result of the detonation of a charge located, at least partially, within the stemming device.

Devices with combined or attached blasting and stemming aspects are also known. U.S. Pat. No. 6,339,992 issued to Watson on Jan. 22, 2002 discloses a small charge blasting apparatus which includes a device for sealing pressurized fluids, including standard propellant, in holes. U.S. Pat. No. 4,546,703 issued to Thompson on Oct. 15, 1985 teaches a pre-packaged explosive charge, comprised of modules having a threaded male coupling end and a threaded female coupling end, which may also have a plug fitting threadably attachable to a charge module. U.S. Pat. No. 2,685,836 issued to Sauvage on Aug. 10, 1954 discloses a priming and tamping device for explosives in blast holes which can be attached to an explosive. U.S. Pat. No. 1,832,132 issued to Lanier et al. on Jan. 14, 1928 discloses a blasting shell which has a threaded part for stemming the shell in a borehole. The French patent FR 1,011,964 appears to show a blasting shell with a stemming aspect attached to one end thereof. German patents DE 651,287 and DE 305,020 also appear to show a blasting shell with a stemming aspect attached to one end thereof.

Various other known stemming devices and methods used to plug boreholes exist. U.S. Pat. No. 6,386,111 issued to Shann on May 14, 2002 discloses a stemming arrangement and method for blast holes which includes a hollow member, having a curved portion with stemming material contained therein, wherein the hollow member deforms upon detonation of an explosive thereby stemming the hole. U.S. Pat. Nos. 5,247,886 and 4,754,705, issued to Worsey, on Sep. 28, 1993 and Jul. 5, 1988 respectively, show mechanical stemming devices for use in boreholes which are placed outward from the explosive in the hole. U.S. Pat. No. 3,952,656 issued to Fox et al. on Apr. 27, 1976 discloses a stemming device which is composed of a resilient material capable of forming a seal along the walls of a borehole. U.S. Pat. No. 2,296,504 issued to Crater on Jul. 8, 1938 shows a "blasting plug" which consists of a two part stemming device that stems the borehole upon detonation of a charge disposed in the borehole adjacent the foot of the hole. U.S. Pat. No. 2,007,568 issued to Heitzman on Dec. 6, 1934 discloses a blasting plug (stemming device) which consists of two parts that stem the borehole upon detonation of a charge disposed inward from the blasting plug. The British patent, GB 2164, discloses a tamping method and devices which comprise a series of soft clay and hard clay plugs that operate together to stem a borehole.

SUMMARY OF THE INVENTION

The present invention relates to a propellant cartridge for inserting in a borehole (B) to break hard material, such as rock or concrete. The cartridge (12), of the present invention, has the advantage of being self-stemming. The present invention contains an accelerant (22) and a self-stemming mechanism (21) adjacent the accelerant (22) incorporated within the same casing (18). Upon detonation of the accelerant (22) within the cartridge (12), using a fuse (14) actuated through ignition, the self-stemming mechanism (21) stems the borehole (B). The self-stemming cartridge (12) concentrates the force of the blast into the bottom of the hole (B) below the stemming mechanism (21) of the cartridge (12) and thereby facilitates cracking the hard material (R).

The present invention incorporates both the blasting material (accelerant) and the damping device within the same outer casing, and also is used for small scale blasting. Since the self-stemming cartridge (12) of the present invention is an all in one device, which may be ready to use from the manufacturing process, no consideration needs to be given for the tamping/charge positioning other than to place the cartridge (12) in a borehole (B) in the proper orientation with the blasting portion adjacent the foot of the borehole (B) and the stemming portion in the direction of the mouth of the borehole (B). This aspect of the combination of an explosive compound with a stemming mechanism (21) in the same structure adds simplicity of use and greatly increases productivity of the present invention.

After placement within the material to be cracked and upon initiation of the self-stemming cartridge (12), pressure quickly builds up within the cartridge (12) forcing the self stemming mechanism (21) to expand within the borehole (B) locking the stemming components in place and containing most of the pressure generated by the accelerant (22) to allow it to literally push the material apart. At the point in time when the rock cracks, pressure is relieved in the borehole (B) and the burn rate of any remaining accelerant (22) drops off. This effect greatly enhances safety because the cartridge (12) is self limiting in its rate of the delivery of energy to the work.

The present invention consists of a cardboard, paper, plastic or other rigid, easily rupturable, cylindrical assembly containing an accelerant (explosive charge), suitable initiating device actuated by fire or an electrical charge, and a stemming mechanism. This allows the user to drill the required hole in the material to be cracked, place the cartridge within the hole, wire the shot where using an electrical actuation, and detonate it from a safe distance. The use of accelerants, such as smokeless powders or black powders, given their pressure dependant burn rates, is an excellent choice for use as the explosive material, yielding far less fly rock than traditional high explosives, thereby increasing the safety of the self-stemming cartridge. The low propagation rate of propellants, such as smokeless powders, also lessens collateral damage by eliminating destructive high velocity shock waves inherent with high explosives. The terms accelerant, propellant and explosive are used herein interchangeably; the present invention is seen to encompasses all of these substances.

The present invention incorporates both the accelerant (22) and the damping (also known as the stemming) mechanism (21) within the same structure, and operates using the blast to activate self-stemming. This aspect of the invention eliminates the difficulty of placing a stemming device on top of an explosive device.

Another aspect of this device is the use of a very small charge which fits into an easily ruptured cylinder. The cylindrical casing (18) of the present invention may be made of paper, plastic, cardboard, and the like which is easily rupturable upon detonation of the accelerant (22).

Yet another aspect of the present invention is that the borehole (B) itself is used to contain the accelerant (22). Once the rock (R) is cracked, the pressure is released, and the accelerant (22) simply burns up at a much slower rate.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
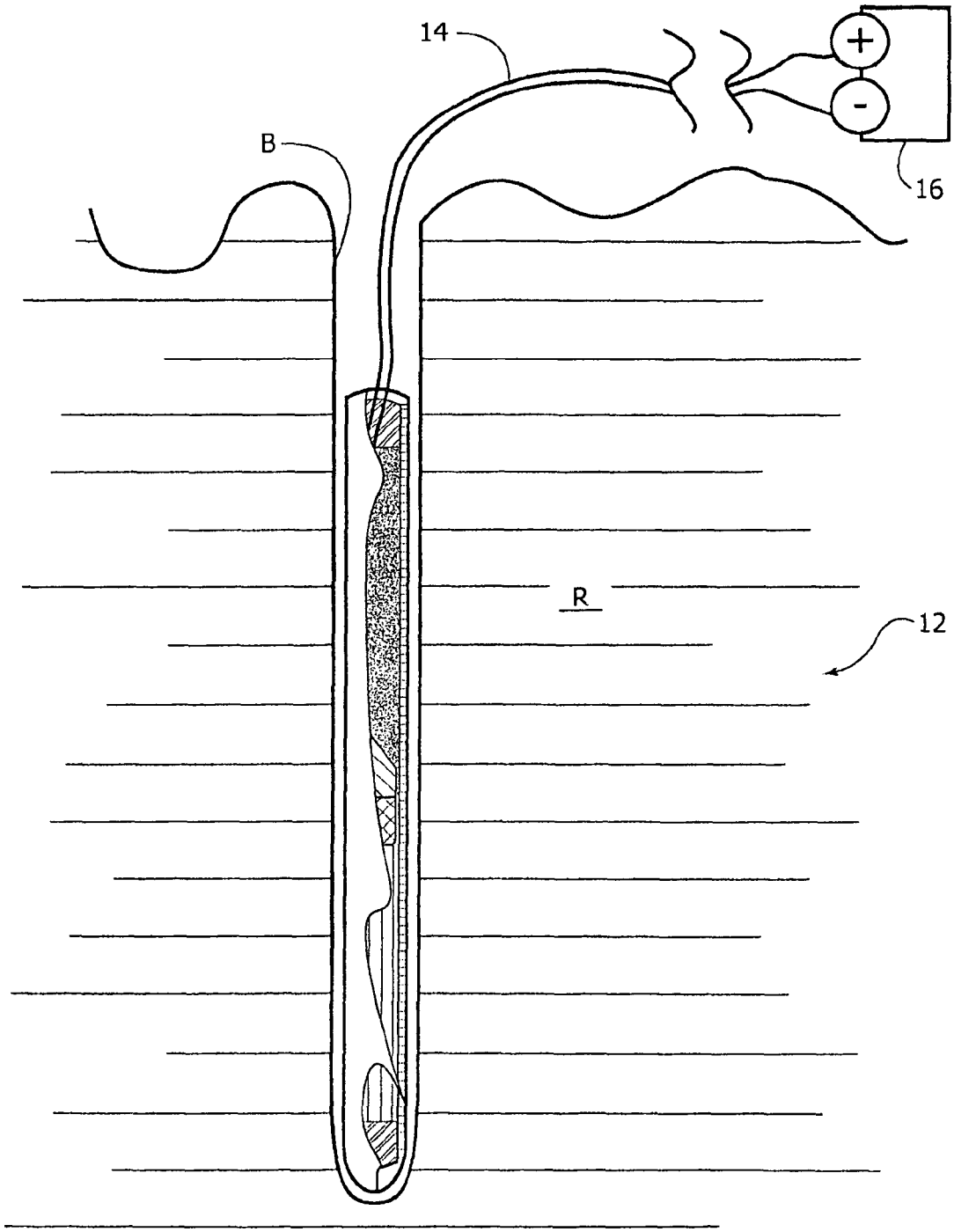
FIG. 1 is an environmental cutaway of a borehole (B) in a rock (R) with a self-stemming cartridge (12) disposed therein and having the fuse (14) extending out of the mouth of the borehole (B) to an electrical charge source (16) according to an embodiment of the present invention.

A self-stemming cartridge (12), as shown in FIGS. 1, 2B, 3, 4, has a cylindrical casing (18) with a first end (33) and a second end (31). The first end (33) is closed. The first end (33) may be closed by crimping which is well known but may also be closed by a plug (20), such as a hot glue plug, as shown. The crimping method of closing the first end (33) may be preferred for automated manufacturing. The cylindrical casing (18) encloses an accelerant (22) disposed adjacent the first end (33), and at least one stemming mechanism (21) disposed between the accelerant (22) and the second end (31). A fuse (14 or 14') extends from the accelerant (22) out of the second end (31) of the cylindrical casing (18).

The explosive material, or accelerant, is preferably a propellant, such as smokeless powders, black powders, or the like. Although high explosives are not the preferred explosive material, the present invention is seen to encompass embodiments which contain such explosives. High explosives are not preferred predominantly because of the resultant force released which increases the danger involved. There are circumstances under which such an embodiment of the present invention is desirable. The user must use extra caution while using such an embodiment of the present invention.

A method of breaking hard material (R) involves drilling a borehole (B) in a hard material such as rock or concrete, placing the self-stemming cartridge (12) in the borehole (B) with the explosive part toward the foot of the borehole (B) and the stemming part towards the mouth of the borehole (B), and detonating the accelerant (22). The cartridge (12), not containing a high explosive, is safe until placed within the material to be broken and connected to an appropriate blasting mechanism for detonation. After placement within the material to be cracked and upon initiation of the self-stemming cartridge (12), pressure quickly builds up within the cartridge (12) forcing the self-stemming components (21) to expand within the borehole (B) locking the stemming components (21) in place and containing most of the pressure generated by the accelerant (22) to allow it to literally push the material apart. At the point in time when the rock cracks, pressure is relieved in the borehole (B) and the burn rate of any remaining accelerant (22) drops off. This effect greatly enhances safety because the cartridge (12) is self limiting in its rate of the delivery of energy to the work.

In some embodiments, shown in FIGS. 1, 2B, 3 and 5A the fuse (14) is connected to an igniter (24). The igniter (24) is disposed in the accelerant (22) in contact with the fuse (14) which consists of two wires. An electrical charge is applied to the fuse (14) to actuate the igniter (24) and detonate the accelerant (22). A 34 to 38 gauge nichrome wire soldered to a 22 to 26 gauge copper leads make a suitable igniter (24)/fuse (14) combination. The fuse (14) may extend three (3) feet or more from the second end (31) of the cylindrical casing (18).

Figure 2A:
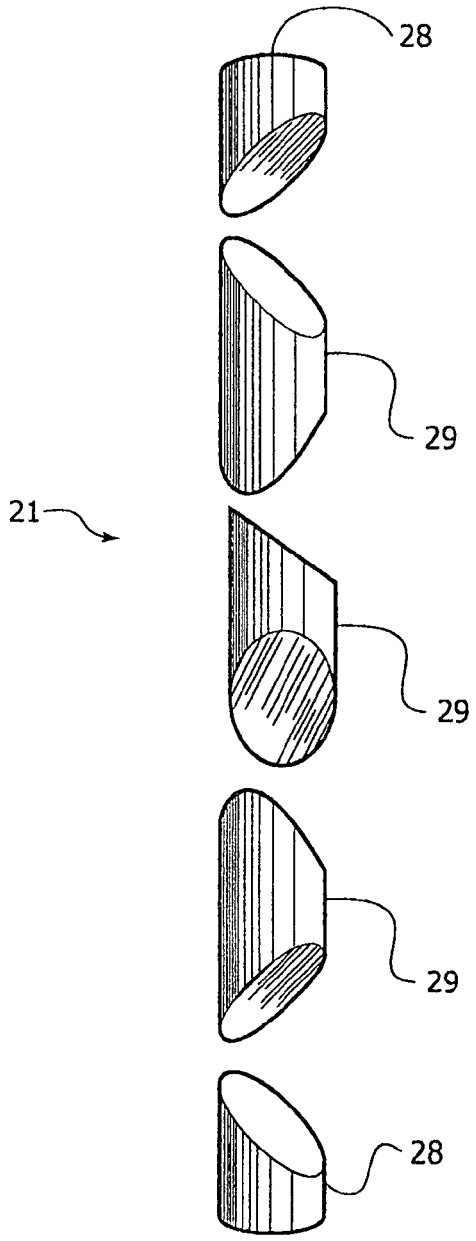
FIG. 2A is a perspective view of a stemming mechanism (21) of the present invention according to another embodiment of the present invention consisting of a dowel rod cut into separate dowels (28 and 29), one of which has opposing angled flat sides (29) and the other forms a wedge.
Figure 2B:
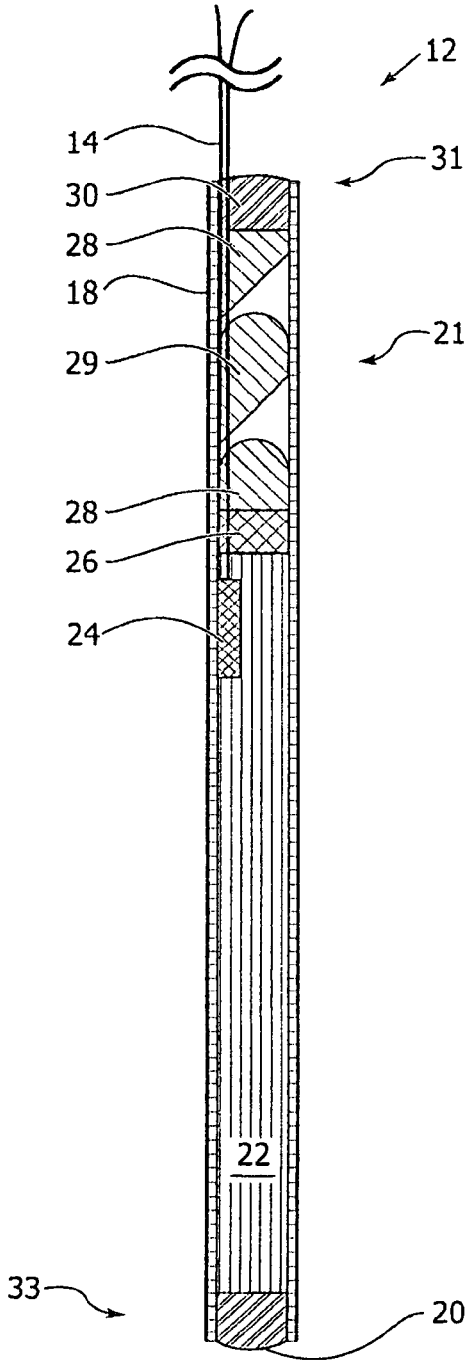
FIG. 2B is a cutaway side view of a self-stemming cartridge (12) according to an embodiment of the present invention in which two wedges (28) and a single opposing angled dowel (29) as shown in FIG. 2A are disposed within the cylindrical casing (18).
Figure 3:
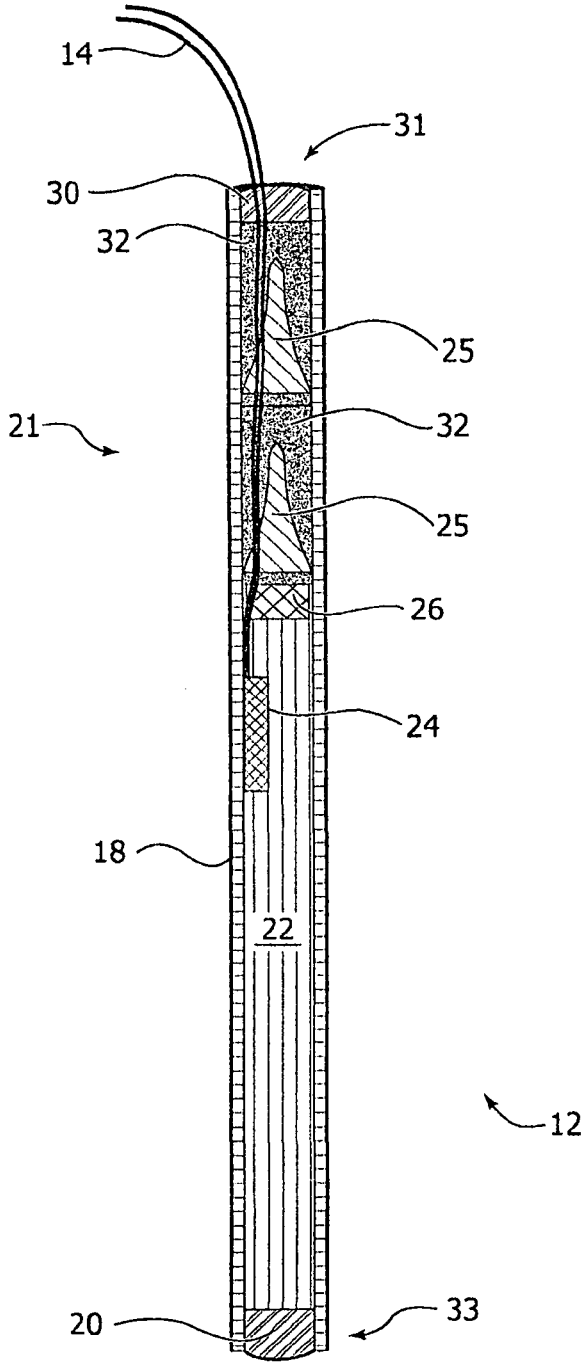
FIG. 3 is a cutaway side view of a self-stemming cartridge (12) according to yet another embodiment of the present invention.
Figure 4:
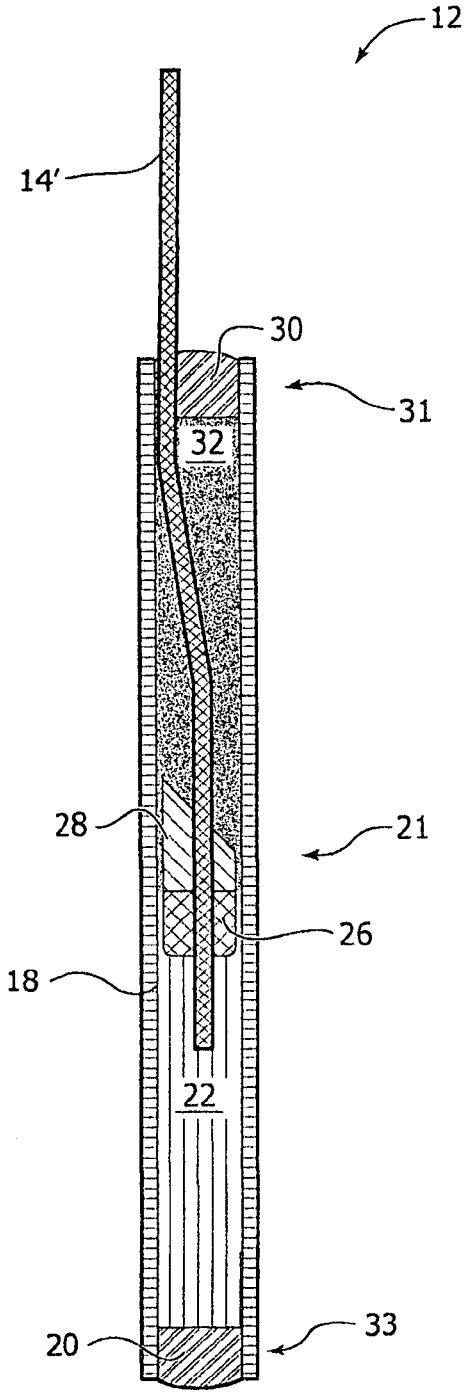
FIG. 4 is a cutaway side view of a self-stemming cartridge (12) according to another embodiment of the present invention.

The first of the at least one stemming mechanisms (21) is disposed adjacent the accelerant (22) opposite the first end (33). In alternative embodiments of the present invention, the stemming mechanism consists of at least one stemming cone, while in another embodiment the invention consists of at least one dowel with opposing flat angle cut ends cut from a dowel rod. Regular sides or bases are not necessary for the stemming mechanism to function. For example, a golfing tee may be used in place of regularly cut cone. Grit may be disposed about the stemming mechanism to strengthen the stemming action of the stemming mechanism. Typically, the stemming mechanism (21) is a round based wedge (28), dowel having opposing sides cut into the length at an angle (29), a conical shape (27), and a concave sided conical shape (25). The stemming mechanisms (21) may be made of wood, plastic, stone, or other substantially rigid material, as suitable. The round based wedge (28) and dowel having opposing sides cut into the length at an angle (29) are shown in FIG. 2A.

A partition (26) may be disposed between the accelerant (22) and the at least one stemming mechanism (21), such as a conformable plug, plasticene, putty, or other suitable material. Grit (32), comprised of a well known sharp-edged hard material, may be disposed within the cylindrical casing (18) between the accelerant (22) and the second end (31) thereof encompassing the at least one stemming mechanism (21) therein. The cylindrical casing (18) may have a high friction external surface (18), such as sand paper. Alternatively, the cylindrical casing (18) may be made of paper, cardboard, plastic or other rigid, easily rupturable assembly.

Figure 5A:
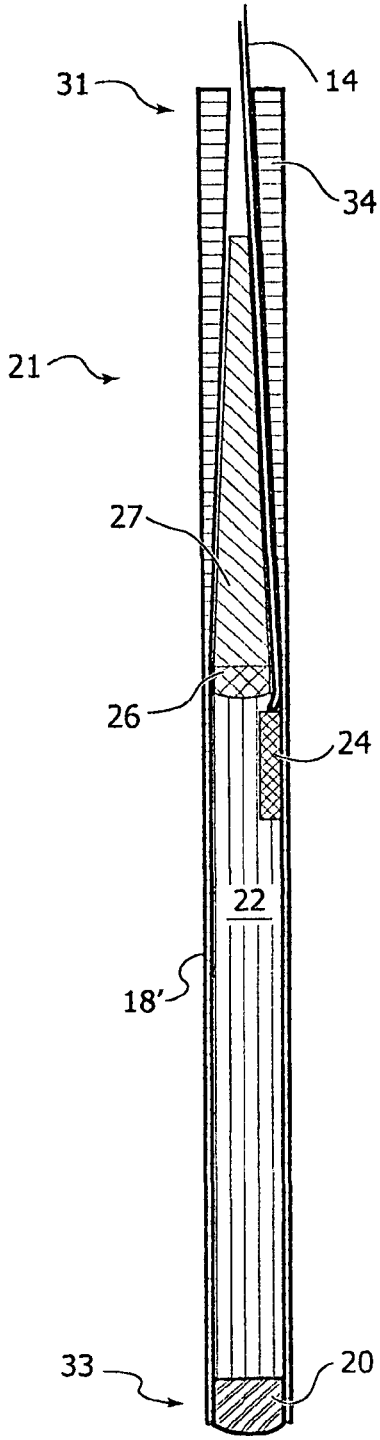
FIG. 5A is a cutaway side view of a self-stemming cartridge (12) according to another embodiment of the present invention.
Figure 5B:
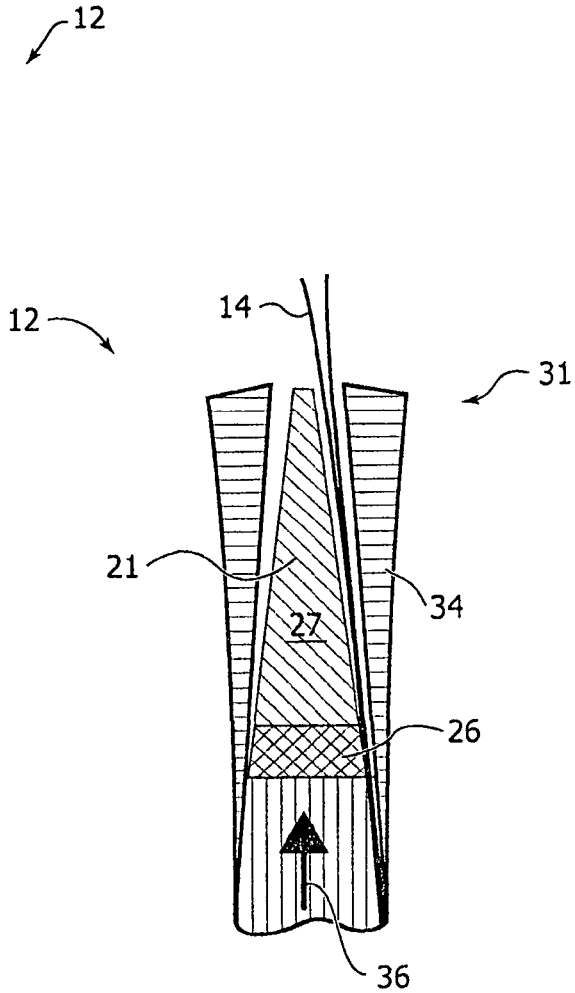
FIG. 5B is another cutaway side view of the self-stemming cartridge (12) of the embodiment depicted in FIG. 5A.

Furthermore, the second end (31) is typically closed; however, it need not be as shown in FIGS. 5A and 5B. The second end (31) may also be crimped, as long as it accommodates the fuse, but it may also be composed of a plug (30) which may be made be hot glue or castable material. The cylindrical casing (18'), of FIGS. 5A and 5B, becomes thicker towards the second end (31) thereof. The stemming mechanism (21) used in the embodiment of FIGS. 5A and 5B has a conical shape (27) and fits snuggly within the cylindrical casing (18') with the base the conical shaped (27) stemming mechanism (21) extending towards the accelerant (22). Upon actuation of the fuse, the force (36) of the blast pushes the conical shaped (27) stemming mechanism (21) towards the open second end (31) forcing the thicker part (34) of the cylindrical casing (18') outward thereby stemming the borehole (B).

A method of breaking hard material (R), according to the present invention, involves drilling at least one borehole (B) in a hard material (R), providing at least one self-stemming cartridge (12), inserting the self-stemming cartridge (12) into the borehole (B), verifying that the fuse (14 or 14') extends out the opening in the borehole (B), and detonating the self-stemming cartridge (12) by actuating the fuse (14 or 14'). A burnable fuse (14) may be actuated by applying fire to the exposed fuse 14 extending out of the second end (31) of the cylindrical casing (18). Alternatively, the fuse (14) may be actuated by the fuse (14) by applying an electrical current of sufficient strength to actuate an igniter (24) disposed in the accelerant (22) at the end of the fuse (14).

Alternative methods of breaking rock (R) include drilling multiple boreholes (B) in a now in the hard material (R), and detonating each of the boreholes (B) in the row at the same time. Electrical actuation of a fuse (14) with an igniter (24) is necessary to simultaneously detonate the self-stemming cartridges (12) in more than one borehole (B). Similarly, it is sometimes desirable to drill multiple rows of boreholes (B) each row of boreholes (B), comprising multiple boreholes (B), being substantially parallel to one another, detonating each of the self-stemming cartridges (12) in each row at the same time, and detonating each row of self-stemming cartridges (12) sequentially. Alternatively, multiple boreholes (B) may be used in a nonlinear manner depending on the desired application.

Method of making a self-stemming cartridge (12) involves providing a cylindrical casing (18) having first (33) and second ends (31), providing a fuse (14), closing a first end (33) of the cylindrical casing (18), depositing the accelerant (22) within the cylindrical casing (18), inserting the fuse (14) into the accelerant (22) wherein the fuse (14) extends from the accelerant (22) out of the second end (31) of the cylindrical casing (18), and inserting a stemming mechanism (21) into the cylindrical casing (18) with the fuse (14) extending therethrough and out of the second end (31) of the cylindrical casing (18). The second end (31) of the cylindrical casing (18) may be closed. A partition (26) may be inserted between the accelerant (22) and fuse (14), and the stemming mechanism (21). Alternatively, the fuse (14) or the stemming mechanism (21) may be positioned first in the cylindrical casing (18).

A dowel rod may be cut at a plurality of places wherein each cut is at an angle to the cross section of the dowel rod to form a plurality of stemming mechanisms (21), see FIG. 2A. An example of stemming mechanisms (21) are shown in FIG. 2A, with one end having 45° cut and the other having a 90° cut results in the wedge (28), which may be placed at either end of the "stack" of stemming mechanisms (21). Where both ends were cut at 45° angles but rotated 90° between cuts results in the second type (29).

Grit (32) may also be inserted about the stemming mechanism (21). The grit (32) used may be screened sharp sand, or any other analogous material suitable for the purpose. Screen hard limestone which has been put through a crusher containing dust to gravel eliminating everything else but 1/16" to 3/16" grains has been used.

Other embodiments containing different stemming configurations, for example, by using other ramp geometries, chevron packing arrangements and reverse collets are also contemplated by the present invention. Also, further methods of enclosing the tube in addition to hot glue plugs, such as crimping as are well known in the art, are also contemplated by the present invention.

It is to be understood that the present invention is not limited to the embodiments described above, but encompasses any and all embodiments within the scope of the following claims.

What is claimed is:

1. A self-stemming cartridge (12), comprising:

an easily rupturable cylindrical casing (18) having a first end (33) and a second end (31);

the first end (33) being closed; wherein the cylindrical casing (18) encloses an accelerant (22) disposed adjacent the first end (33), and at least one stemming mechanism (21), taken from the group consisting of a round based wedge (28), dowel having opposing sides cut into the length at an angle (29), a conical shape (27), and a concave sided conical shape (25), disposed between the accelerant (22) and the second end (31); and a fuse (14 or 14') extending from the accelerant (22) out of the second end (31) of the cylindrical casing (18).

2. The self-stemming cartridge (12) of claim 1, further comprising:

an igniter (24) disposed in the accelerant (22) in contact with the fuse (14), wherein an electrical charge applied to the fuse (14) actuates the igniter (24) to detonate the accelerant (22).

3. The self-stemming cartridge (12) of claim 1, wherein:

a first of the at least one stemming mechanism (21) is disposed adjacent the accelerant (22) opposite the first end (33).

4. The self-stemming cartridge (12) of claim 1, further comprising:

a partition (26) disposed between the accelerant (22) and the at least one stemming mechanism (21).

5. The self-stemming cartridge (12) of claim 1, further comprising:

grit (32) disposed within the cylindrical casing (18) between the accelerant (22) and the second end (31) thereof encompassing the at least one stemming mechanism (21) therein.

6. The self-stemming cartridge (12) of claim 1, wherein:

the second end (31) is closed.

7. The self-stemming cartridge (12) of claim 1, wherein:

the cylindrical casing (18) has a high friction external surface (18).

8. The self-stemming cartridge (12) of claim 1, wherein:

the cylindrical casing (18') becomes thicker towards the second end (31) thereof.

9. The self-stemming cartridge (12) of claim 8, wherein:

the stemming mechanism (21) has a conical shape (27) and fits snuggly within the cylindrical casing (18') with the base the conical shaped (27) stemming mechanism (21) extending towards the accelerant (22).

10. The self-stemming cartridge (12) of claim 1, further comprising:

an igniter (24) disposed in the accelerant (22) in contact with the fuse (14), wherein an electrical charge applied to the fuse (14) actuates the igniter (24) to detonate the accelerant (22).

11. The self-stemming cartridge (12) of claim 1, wherein:

a first of the at least one stemming mechanism (21) is disposed adjacent the accelerant (22) opposite the first end (33).

12. The self-stemming cartridge (12) of claim 1, further comprising:

a partition (26) disposed between the accelerant (22) and the at least one stemming mechanism (21).

13. The self-stemming cartridge (12) of claim 1, further comprising:

grit (32) disposed within the cylindrical casing (18) between the accelerant (22) and the second end (31) thereof encompassing the at least one stemming mechanism (21) therein.

14. The self-stemming cartridge (12) of claim 1, wherein:

the second end (31) is closed.

15. The self-stemming cartridge (12) of claim 1, wherein:

the cylindrical casing (18) has a high friction external surface (18).

16. The self-stemming cartridge (12) of claim 1, wherein:

the cylindrical casing (18') becomes thicker towards the second end (31) thereof.

17. The self-stemming cartridge (12) of claim 1, further comprising:

additional stemming mechanisms (21) taken from the group consisting of a round based wedge (28), dowel having opposing sides cut into the length at an angle (29), and a conical shape (27).

18. A method of breaking hard material (R) comprising:

drilling at least one borehole (B) in a hard material (R);

providing at least one self-stemming cartridge (12) comprising an easily rupturable cylindrical casing (18) having a first end (33) and a second end (31), the first end (33) being closed, wherein the cylindrical casing (18) encloses an accelerant (22) disposed adjacent the first end (33), and at least one stemming mechanism (21), taken from the group consisting of a round based wedge (28), dowel having opposing sides cut into the length at an angle (29), a conical shape (27), and a concave sided conical shape (25), disposed between the accelerant (22) and the second end (31), and a fuse (14 or 14') extending from the accelerant (22) out of the second end (31) of the cylindrical casing (18);

inserting the self-stemming cartridge (12) into the borehole (B);

verifying that the fuse (14 or 14') extends out the opening in the borehole (B); and detonating the self-stemming cartridge (12) by actuating the fuse (14 or 14').

19. The method of breaking hard material (R) of claim 18, further comprising:

actuating the fuse (14') by igniting it with a flame.

20. The method of breaking hard material (R) of claim 18, further comprising:

actuating the fuse (14) by applying an electrical current of sufficient strength to actuate an igniter (24) disposed in the accelerant (22) at the end of the fuse (14).

21. The method of breaking hard material (R) of claim 20, further comprising:

drilling multiple boreholes (B) in a row in the hard material (R); and detonating each of the boreholes (B) in the row at the same time.

22. The method of breaking hard material (R) of claim 18, further comprising:

drilling multiple rows of boreholes (B) each row of boreholes (B), comprising multiple boreholes (B), being substantially parallel to one another;

detonating each of the self-stemming cartridges (12) in each row at the same time; and detonating each row of self-stemming cartridges (12) sequentially.

23. A method of making a self-stemming cartridge (12), comprising:

providing an easily rupturable cylindrical casing (18) having first (33) and second ends (31);

providing a fuse (14);

closing a first end (33) of the cylindrical casing (18);

depositing accelerant (22) within the cylindrical casing (18);

inserting the fuse (14) into the accelerant (22) wherein the fuse (14) extends from the accelerant (22) out of the second end (31) of the cylindrical casing (18); and inserting a stemming mechanism (21), taken from the group consisting of a round based wedge (28), dowel having opposing sides cut into the length at an angle (29), a conical shape (27), and a concave sided conical shape (25), into the cylindrical casing (18) with the fuse (14) extending therethrough and out of the second end (31) of the cylindrical casing (18).

24. The method of making a self-stemming cartridge (12) of claim 23, further comprising:

closing the second end (31) of cylindrical casing (18).

25. The method of making a self-stemming cartridge (12) of claim 23, further comprising:

inserting partition (26) between accelerant (22) and fuse (14), and the stemming mechanism (21).

26. The method of making a self-stemming cartridge (12) of claim 23, further comprising:

inserting grit (32) about the stemming mechanism (21).

27. The method of making a self-stemming cartridge (12) of claim 23, further comprising:

cutting a dowel rod at a plurality of places wherein each cut is at an angle to the cross section of the dowel rod to form a plurality of stemming mechanisms (21).

28. A self-stemming cartridge (12), comprising:

an easily rupturable cylindrical casing (18) having a first end (33) and a second end (31);

the first end (33) being closed; wherein the cylindrical casing (18) encloses an accelerant (22) disposed adjacent the first end (33), and at least one stemming mechanism (21) disposed between the accelerant (22) and the second end (31); and a fuse (14 or 14') extending from the accelerant (22) out of the second end (31) of the cylindrical casing (18);

wherein the at least one stemming mechanism (21) comprises a concave sided conical shape (25).

* * * * *